US005085167A

United States Patent [19]

Hebels

[11] Patent Number: 5,085,167

[45] Date of Patent: Feb. 4, 1992

[54] APPARATUS FOR APPLYING COATING MATERIAL TO A SUBSTRATE

[75] Inventor: Albert Hebels, Hamburg, Fed. Rep. of Germany

[73] Assignee: Pagendarm GmbH, Hamburg, Fed. Rep. of Germany

[21] Appl. No.: 558,579

[22] Filed: Jul. 27, 1990

[51] Int. Cl.[5] ..... B05C 3/18; B05C 9/14

[52] U.S. Cl. ..... 118/65; 118/68; 118/202; 118/257; 118/263; 118/641

[58] Field of Search ..... 118/641, 642, 643, 61, 118/59, 64, 65, 68, 66, 67, 202, 257, 263, 419; 427/355, 359, 372.2, 361

[56] References Cited

U.S. PATENT DOCUMENTS

| | | | |
|---|---|---|---|
| 3,795,470 | 3/1974 | De Mets | 264/109 |
| 3,893,761 | 7/1975 | Buchan et al. | 118/641 |
| 3,989,569 | 11/1976 | Newman | 118/257 |
| 4,359,748 | 11/1982 | Pasini et al. | 118/257 |
| 4,764,402 | 8/1988 | Pagendarm | 427/355 |
| 4,886,564 | 12/1989 | Pagendarm | 156/230 |

FOREIGN PATENT DOCUMENTS

| | | | |
|---|---|---|---|
| 920934 | 2/1973 | Canada | 156/583.5 |
| 2346824 | 3/1975 | Fed. Rep. of Germany | 118/202 |

*Primary Examiner*—Jay H. Woo
*Assistant Examiner*—Khanh P. Nguyen
*Attorney, Agent, or Firm*—Peter K. Kontler

[57] ABSTRACT

Apparatus for applying one or more films of coating material to a running substrate of paper or the like has an endless belt which is trained over pulleys so that its upper reach advances toward a transfer station for coating material and its lower reach advances toward a station for the application of liquefied solvent-containing material. The underside of the lower reach of the belt is heated by a set of infrared heaters so that the liquefied coating material is applied to preheated portions of the belt. This promotes and contributes to predictability of expulsion of solvent from the film along the upper reach of the belt and ensures more predictable solidification of coating material ahead of the transfer station.

7 Claims, 1 Drawing Sheet

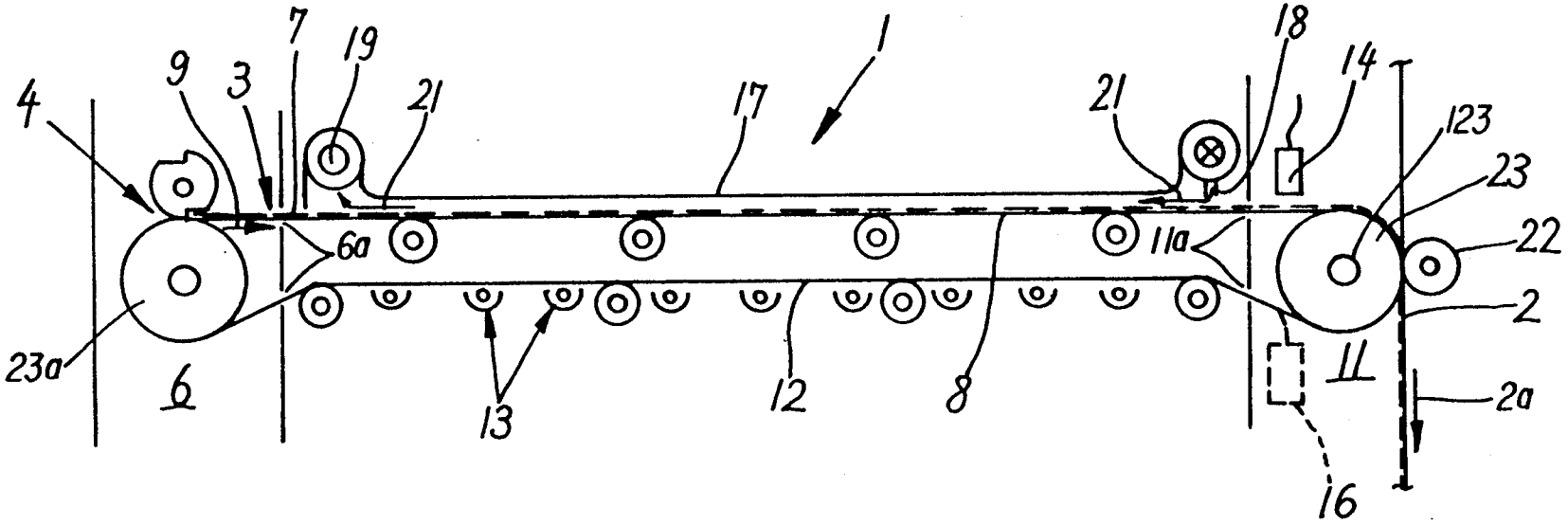
1
2
2a
3
4
6
6a
7
8
9
11
11a
12
13
14
16
17
18
19
21
21
22
23
23a
123

APPARATUS FOR APPLYING COATING MATERIAL TO A SUBSTRATE

CROSS-REFERENCE TO RELATED CASE

The apparatus of the present invention constitutes an improvement over and a further development of apparatus which are disclosed in commonly owned U.S. Pat. No. 4,886,564 granted Dec. 12, 1989 to Ralph Pagendarm and Albert Hebels for "Method of and apparatus for applying coating material to a running substrate". The disclosure of this patent is incorporated herein by reference.

BACKGROUND OF THE INVENTION

The invention relates to improvements in apparatus for applying one or more films or layers of coating material to running substrates of paper, textile, metallic foil, plastic foil or other strip- or web-shaped products. More particularly, the invention relates to improvements in apparatus of the type disclosed in U.S. Pat. No. 4,886,564 which discloses apparatus for the application of a plurality of more or less solidified films or layers of coating material (such as an adhesive, a coloring agent or an impregnating substance) to one side of a running substrate so that successively applied layers or films overlie each other.

The patented apparatus employs several endless carriers which transport films of originally liquefied coating material toward a series of stations where the coating material is transferred onto spaced-apart portions of the substrate or onto the previously applied film or films of coating material. The coating material often contains solvents which must be expelled from the coating material in a predictable manner in order to prevent the development of blisters and/or other irregularities which could affect the appearance and/or quality of the finished product, e.g., adhesive tape, band aid or the like.

OBJECTS OF THE INVENTION

An object of the invention is to provide an apparatus wherein the expulsion of solvent from liquefied coating material can be carried out in a highly predictable manner.

Another object of the invention is to provide an apparatus which renders it possible to expel and recover high percentages of solvent which is contained in liquefied coating material.

A further object of the invention is to provide a novel and improved method of heating the carrier or carriers of coating material in a substrate coating apparatus of the above outlined character.

An additional object of the invention is to ensure gradual solidification of liquefied coating material on the way toward the locus of transfer onto a running substrate.

SUMMARY OF THE INVENTION

The invention resides in the provision of an apparatus for coating a running substrate with coating material. The improved apparatus comprises at least one heatable endless carrier defining an elongated path having a first portion adjacent the running substrate, a second portion and a third portion, means for driving the carrier in a predetermined direction so that successive increments of the endless carrier repeatedly advance seriatim along the first, second and third portions of the path, means for applying to the carrier a layer or film of coating material in the third portion of the path, means for transferring the film from the carrier onto the substrate in the first portion of the path, and means for heating the carrier in the second portion of the path so that successive increments of the carrier are already heated at the time of entering the third portion of the path.

The apparatus is or can be designed to coat a continuously moving substrate and can further comprise a first chamber for a portion at least of the transferring means and a second chamber for the applying means. The first portion of the path extends through the first chamber, the third portion of the path extends through the second chamber and in the predetermined direction from the second chamber to the first chamber, and the second portion of the path extends in the predetermined direction from the first chamber toward the second chamber.

The second portion of the path is or can be located at a level below the third portion of the path. The second portion of the path is or can be a straight portion, the same as that stretch of the third portion of the path which extends from the second chamber toward the first chamber.

The heating means is or can be adjacent the outer side of the carrier and can comprise at least one infrared heater, for example, an entire battery of infrared heaters which are distributed adjacent the second portion of the path between the first and second chambers.

The carrier can include one or more endless belts, a first pulley for the belt or belts at the first station, and a second pulley for the belt or belts at the second station. The first pulley can form part of the transferring means and at least one of the pulleys can form part of or can receive torque from the driving means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

The single FIGURE of the drawing shows a portion of an apparatus which embodies the invention and wherein a battery of infrared heaters is adjacent the outer side of that portion of an endless carrier which is caused to advance from the transferring means toward the applying means.

DESCRIPTION OF PREFERRED EMBODIMENTS

The apparatus 1 of the present invention is or can be of the type disclosed in U.S. Pat. No. 4,886,564. The single FIGURE of the drawing shows one (3) of several endless carriers of coating material which is transferred onto the left-hand side of a continuously running web-like substrate 2. The latter is driven to advance in the direction of arrow *2a*, and that portion of the substrate which advances along the right-hand end turn of the carrier 3 is located in a first chamber 11. The coating material which is transferred onto the left-hand side of the running substrate 2 can constitute a layer or film of adhesive material. The means for transferring the coating material onto the substrate 2 comprises a pulley 23 for the endless belt or belts (hereinafter belt) of the carrier 3 and a counterroller 22 which defines with the pulley 23 a nip for the substrate 2. The chamber 11 has openings 11*a* (e.g., in the form of horizontal slots) for the upper and lower reaches 8 and 12 of the belt of the carrier 3.

A second chamber 6, which is spaced apart from the first chamber 11, receives the left-hand pulley 23*a* for the respective end turn of the belt forming part of the carrier 3. This chamber confines a device 4 which serves as a means for applying to successive increments of the belt liquefied coating material which forms a thin film or layer 7 extending from the chamber 6 toward and into the chamber 11 to be transferred onto the running substrate 2.

That portion of the belt forming part of the carrier 3 which is trained around the pulley 23*a* and extends from the chamber 6 to the chamber 11 defines an elongated (third) portion of an elongated path; a first portion of such path is defined by that portion of the belt which is trained over the pulley 23 in the chamber 11, and a second portion of such path is defined by the belt portion extending from the chamber 11 to the chamber 6. The means for driving the belt of the carrier 3 comprises a driven shaft 123 which transmits torque to the pulley 23 so that the pulleys 23, 23*a* are rotated in a clockwise direction and the upper reach 8 of the belt advances in a direction (arrow 9) from the chamber 6 toward the chamber 11, i.e., the lower reach 12 advances in a direction from the chamber 11 toward the chamber 6.

The liquefied coating material contains a solvent which is expelled during advancement of successive increments of the film 7 from the chamber 6 toward the chamber 11. The expelled solvent is intercepted and entrained by a stream of inert gaseous carrier fluid (such as nitrogen) which is caused to flow in a shallow elongated channel 17 in a direction from the chamber 11 toward the chamber 6 and is outwardly adjacent the upper reach 8. The outlet of a source of gaseous carrier medium is shown at 18; such medium flows in the direction of arrows 21 to entrain the expelled solvent in the channel 17 and to leave the channel at 19. The manner in which the solvent is recovered from the gaseous carrier medium is known and need not be described here. Reference may be had, for example, to commonly owned U.S. Pat. No. 4,764,402 granted Aug. 16, 1988 to Ralph Pagendarm and Albert Hebels for "Method of and apparatus for applying coating material to a running web".

The solvent is expelled from the film 7 by heating the belt of the carrier 3 in a novel way, namely by a battery of infrared heaters 13 which are outwardly adjacent the lower reach 12. The arrangement is such that the radiation sources of the infrared heaters 13 (each such heater can comprise a radiation source extending transversely of the lower reach 12 and a reflector which directs radiation toward the outer side of the lower reach 12) directly preheat successive increments of the belt prior to arrival of such increments into the range of the applying means 4 for liquefied coating material. Thus, the exterior of the belt of the carrier 3 is heated more intensively than the inner layer or layers; this ensures that the freshly applied increments of the film 7 are subjected to more intensive heating and drying (solvent-expelling) action in the region where they leave the chamber to advance (with the upper reach 8) toward the chamber 11. The heating and drying action of the belt upon the film 7 decreases in a direction from the chamber 6 toward the chamber 11 because the upper reach 8 dissipates heat as its increments advance toward the transferring means 22, 23 in the chamber 11.

Rapid drying of successive increments of the film 7 in the region close to the chamber 6 (i.e., high diffusion speed of solvent on its way from the interior of the film 7 toward and into the channel 17) is desirable and advantageous because the solvent can escape without adversely affecting the exposed surface of the film. The reason is believed to be that the film portion which is adjacent the respective opening 6*a* in the chamber 6 is yet to become solidified so that it does not offer pronounced resistance to escape of the solvent into the channel 17. In other words, the exposed side of the film 7 in the region of the chamber 6 does not (as yet) constitute an effective barrier to diffusion of the solvent. Solidification of the exposed side of the film 7 begins as the film continues to advance with the upper reach 8 on its way toward and into the chamber 11 to be transferred onto the adjacent side of the continuously running substrate 2. As mentioned above, the temperature of the upper reach 8 decreases in a direction from the chamber 6 toward the chamber 11 so that the solidification of the upper side of the film 7 is relatively slow to thus enable at least a very high percentage of solvent to escape from the interior of the film 7 into the channel 17 and to be entrained in the direction of arrows 21.

The temperature of the upper reach 8 can be indirectly monitored in the chamber 11 by a first temperature sensing element 14 in the chamber 11 and/or directly by a second temperature sensing element 16 which is or can be optional and, therefore, is indicated by broken lines. The heaters 13 (or at least some of these heaters) are adjustable so that the temperature of successive increments of the lower reach 12 which arrive at the chamber 6 can be regulated in response to signals which are transmitted by the sensing element 16 and/or 14. Reference may be had to the description of FIG. 2 in U.S. Pat. No. 4,886,564.

An important advantage of the improved apparatus is that it ensures the expulsion (and hence recovery) of large percentages of solvent from the film 7 which is advanced from the applying means 4 in the chamber 6 to the transferring means in the chamber 11. This is achieved in that the lower reach 12 is directly heated by the heaters 13 in such a way that its external surface is subjected to maximum heating action. This ensures predictable and rapid expulsion of solvent and, in addition, contributes to optimal solidification of liquefied coating material which is delivered by the applying means 4. It has been found that expulsion of solvent and the rate of drying of the film 7 are highly predictable even if the percentage of solvent in successively applied increments of the film fluctuates within a rather wide range. The improved apparatus ensures the availability of large quantities of heat energy in the foremost zone of that (third) portion of the elongated path which is defined by the carrier 3 in the region where the film 7 undergoes an initial heating and drying action because preheating of the belt (i.e., heating ahead of the applying means 4) is most pronounced at the exterior of the belt. As mentioned above, this results in high diffusion velocity and in expulsion of large quantities of solvent in close proximity to the chamber 6 before the outer side of the film 7 hardens, i.e., before the outer side of the film can constitute an effective barrier to expulsion or escape of solvent from the interior of the film. The feature that a high percentage of solvent can escape from the interior of the film 7 in a region close to the chamber 6 ensures that the film does not develop blisters containing entrapped solvent on its way toward and into the chamber 11. Gradual cooling of the upper reach 8 in a direction from the chamber 6 toward the chamber 11 also contributes to the formation of a highly satisfactory film which is devoid of blisters and can be transferred onto the left-hand side of the running substrate 2.

The exact composition of the coating material forms no part of the present invention. For example, and as described in U.S. Pat. No. 4,886,564, the coating material may contain an adhesive, a coloring agent, an impregnating substance or the like. The substrate 2 can consist of or contain paper (e.g., crepe paper), textile material, plastic foil (e.g., a foil of thermoplastic material), metallic foil and/or others.

The apparatus of the present invention will be put to use when it is advisable to permit the film of coating material to undergo a certain amount of solidification prior to transfer onto the substrate. Moreover, the apparatus of the present invention can be used with advantage for the application to a running substrate of two or more superimposed films of coating and/or other material, e.g., in a manner as disclosed in U.S. Pats. Nos. 4,764,402 and 4,886,564.

Recovery of solvent is desirable but optional. In many instances, the gaseous carrier medium for expelled solvent is an inert gas, particularly nitrogen.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for coating a running substrate with a coating material, comprising at least one heatable endless carrier defining an elongated path having a first portion adjacent the running substrate, a second portion and a third portion; means for driving said carrier in a predetermined direction so that successive increments of the carrier repeatedly advance seriatim along said first, second and third portions of said path; means for applying to the carrier a film of coating material in said third portion of said path; means for transferring the film from the carrier onto the substrate in the first portion of said path; and means for heating the carrier in the second portion of said path so that successive increments of the carrier are preheated at the time such increments receive a film of coating material in the third portion of said path.

2. The apparatus of claim 1 for coating a continuously running substrate, further comprising a first chamber for said transferring means and a second chamber for said applying means, said first portion of said path extending through said first chamber, said third portion of said path extending through said second chamber and in said direction from said second chamber to said first chamber, and said second portion of said path extending in said direction from said first chamber toward said second chamber.

3. The apparatus of claim 1, wherein said second portion of said path is located at a level below said third portion.

4. The apparatus of claim 1, wherein said carrier has an outer side and said heating means is adjacent said outer side.

5. The apparatus of claim 1, wherein said heating means comprises at least one infrared heater.

6. The apparatus of claim 1, wherein said heating means includes a battery of heaters, said carrier having an outer side adjacent said heaters.

7. The apparatus of claim 1, wherein said carrier includes an endless belt, a first pulley for said belt adjacent said transferring means and a second pulley for said belt adjacent said applying means.

* * * * *